US006910305B1

(12) United States Patent
Kassis

(10) Patent No.: US 6,910,305 B1
(45) Date of Patent: Jun. 28, 2005

(54) REINFORCED CONCRETE ELEMENT

(75) Inventor: Fahim Kassis, Kuwait (KW)

(73) Assignee: Fahim Cassis (KW)

( * ) Notice: Subject to any disclaimer, the term of this patent is extended or adjusted under 35 U.S.C. 154(b) by 0 days.

(21) Appl. No.: 10/030,560

(22) PCT Filed: Dec. 3, 1999

(86) PCT No.: PCT/IB99/01929

§ 371 (c)(1),
(2), (4) Date: May 28, 2002

(87) PCT Pub. No.: WO01/04432

PCT Pub. Date: Jan. 18, 2001

(30) Foreign Application Priority Data

Jul. 7, 1999 (LB) ..... 2183
Sep. 6, 1999 (AU) ..... PQ2579

(51) Int. Cl.[7] ..... E04B 2/12; E04B 2/66; E04C 2/30; E04C 5/00

(52) U.S. Cl. ..... 52/233; 52/600; 52/606; 52/608; 52/724.1

(58) Field of Search ..... 52/600, 606, 724.1, 52/721.1, 561, 223.8, 233, 223.6, 608

(56) References Cited

U.S. PATENT DOCUMENTS

| | | | | | |
|---|---|---|---|---|---|
| 1,843,041 | A | * | 1/1932 | Nagel | 405/273 |
| 2,130,231 | A | * | 9/1938 | Forcies | 52/233 |
| 3,672,112 | A | | 6/1972 | Sions et al. | |
| 3,849,960 | A | * | 11/1974 | Henry et al. | 52/569 |
| 4,288,955 | A | | 9/1981 | Hiatt | |
| 4,300,746 | A | | 11/1981 | Schoen | |
| 4,433,519 | A | * | 2/1984 | Jenkins | 52/233 |
| 4,485,604 | A | | 12/1984 | Palamara | |
| 5,253,458 | A | * | 10/1993 | Christian | 52/233 |
| 5,421,135 | A | * | 6/1995 | Stevens et al. | 52/604 |
| 5,881,515 | A | * | 3/1999 | George | 52/233 |
| D464,442 | S | * | 10/2002 | Clark et al. | D25/116 |
| 6,505,446 | B1 | * | 1/2003 | McCrary | 52/233 |
| 6,543,193 | B2 | * | 4/2003 | Houseal | 52/233 |
| 2003/0054189 | A1 | * | 3/2003 | Morgenstern | 428/540 |
| 2003/0136065 | A1 | * | 7/2003 | Gjems | 52/233 |

FOREIGN PATENT DOCUMENTS

| | | | | |
|---|---|---|---|---|
| BE | 820202 | | 1/1975 | |
| DE | 1609361 | | 4/1975 | |
| EP | 362892 | | 8/1989 | |
| FR | 994149 | | 11/1951 | |
| FR | 2282515 | | 3/1976 | |
| JP | 7-305433 | * | 11/1995 | E04B/2/02 |
| JP | 10061100 | | 3/1998 | |
| JP | 2001-173125 | * | 6/2001 | E04B/2/02 |

OTHER PUBLICATIONS

Derwent Abstract Accession No. A2173 K/01, Class Q44 SU 905401 A (Latv Cons Res Exp) Feb. 15, 1982.

* cited by examiner

*Primary Examiner*—Robert Canfield
(74) *Attorney, Agent, or Firm*—McDonnell Boehnen Hulbert & Berghoff LLP

(57) ABSTRACT

A system for walls and structural slabs is disclosed. It consists of units of a pre-case reinforced concrete element has a special form design, fabrication methods and utilisation. The element has a circular section, variable lengths and flat surface on the top and bottom sides (2). It has a sectional area of 4170 sq mm. The optimum preferred dimensions of the cross section are 64 mm high and 75 mm wide (1). The element has an optimum shape that reduces the materials used yet provides the structural performance required. When stacked vertically between two structural framing columns, the elements form non-load-bearing walls system(3). The elements form structural diaphragm when horizontally laid side by side in a butt-jointed manner, supported on both ends by means of structural framing beams. Plain concrete topping to the necessary thickness is cast over the diaphragm/elements, forming an integral reinforced concrete structural slab system (4). The elements are fabricated mechanically or manually. Manual fabrication using PCV moulds produces individual elements of various lengths. Machine fabrication allows production of jointed elements forming slabs of various widths and lengths.

7 Claims, 6 Drawing Sheets

55
60
5

57
5

55
30

13
5
12

REINFORCED CONCRETE ELEMENT

TECHNICAL FIELD OF THE INVENTION

The present invention relates to a reinforced concrete element.

BACKGROUND OF THE INVENTION

Reinforced concrete elements are generally used as building construction material for walls and slabs.

The predominant techniques used in reinforced concrete construction are mostly based on previously set models. The technical research on reinforced concrete as a building construction material is extensive with particular emphasis placed on its physical performance. Most of the applications in the field utilise heavy equipment, extensive amounts of formwork or a combination of both. Advanced technical know how is required but may not be readily available. All of these factors result in prohibitive or redundant costs.

Unfortunately, reinforced concrete is expensive. These costs are due to factors such as: cost of technical expertise, cost of design, supervision and skilled labour; cost of materials and material handling; equipment and labour; formwork and related labour; and construction time.

It would therefore be desirable to have a reinforced concrete element which is designed such that it maximises the benefits of the material and concurrently reduces costs.

OBJECT OF THE INVENTION

It is an object of the present invention to overcome or ameliorate some of the disadvantages of the prior art or at least to provide a useful alternative.

SUMMARY OF THE INVENTION

There is firstly disclosed herein an elongated pre-cast concrete element, said element having:

longitudinally extending upper and lower generally parallel surfaces that enable the element to be stacked with like elements when horizontally oriented; and longitudinally extending convex side surfaces joining the upper and lower surfaces.

There is further disclosed herein a wall structure including a plurality of elements, each element being an element as hereinbefore defined, wherein the elements are stacked so each element is generally horizontally oriented.

The present invention, at least in a preferred embodiment preferably achieves the following: the elimination of formwork for reinforced concrete slabs resulting in a direct cost saving and a positive environmental impact; the elimination of mandatory use of heavy equipment, intensive labour and advanced technical expertise; the substantial reduction in capital investment as a result of major savings achieved through the use of the elements alternative building material; and substantial reduction in the time required for fabrication and construction of walls and slabs.

Therefore, the present invention is preferably a pre-designed, pre-cast reinforced concrete element that is characterised by its cross sectional form. In an individual form, the elements can be utilised for other purposes such as walls of a building structure, partition walls, fencing, planters, tree support posts, pavements, retaining walls, etc.

The present invention is yet further preferably easy to transport and handle without the use of heavy equipment.

Preferably, the present invention is economical to fabricate and build and is generally maintenance free.

BRIEF DESCRIPTION OF THE DRAWINGS

A preferred embodiment of the invention will now be described, by way of example only, with reference to the accompanying drawings, wherein.

DETAILED DESCRIPTION OF THE PREFERRED EMBODIMENTS

Figure 1C:
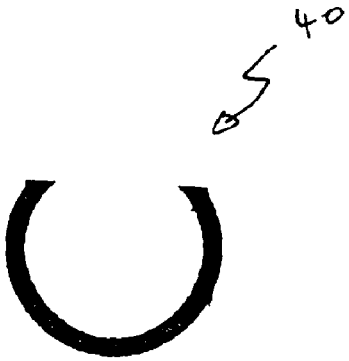
FIGS. 1*c* and 1*d* are cross-sectional view of moulds for the construction of the elements shown in FIGS. 1*a* and 1*b* respectively.

In FIGS. 1A, 1I to 1J and 2 there is depicted a preferred elongate pre-cast concrete element 5. The element 5 has longitudinally extending upper and lower generally parallel surfaces 10, 15 that enable the elements 5 to be stacked as shown, for example, in FIGS. 1I to 1J vertically to form a wall. The element 5 further includes longitudinally extending convex side surfaces 20 joining the upper and lower surfaces 10, 15 to define a cross-section 17. A longitudinal passage 25 is located centrally and extends between the end surfaces 12, 13 and is adapted for receipt for a reinforcing bar such as a reinforced steel bar 30.

The convex sides 20 are designed to provide excellent load bearing capabilities. The preferred cross section 17 of the element 5 has dimensions 64 mm high and 75 mm wide resulting in a cross sectional area 17 of the element 5 of 4170 square millimetres. The length of the element 5 can be any length, but generally between 100 mm and 5000 mm. Advantageously, the width and height of the cross section 17 can be varied to suite the required increase or decrease in the bearing capacity of the element 5. Accordingly, construction using the elements allows an optimal combination between the element cross sectional dimensions and its bearing capacity, with the only constant being the cross sectional design 17. These can be determined by the following:

Structural Parameters and Analysis of the Element Under Different Conditions The design of the element 5 considers the loads and stresses from the following stages:

Handling

Cast of concrete topping

Full service loading in its permanent location

The element is designed utilising the requirements of the ACI-318 code of practice.

The reinforcement percentage in the section is calculated as per the following equation:

$$Mu = \varphi fyAs\left(d - \frac{1}{2}\frac{Asfy}{a0.85fc'}\right)^{*}$$

Mu=Ultimate moment capacity $$As = \rho \frac{bd}{100}$$

ρ=steel percentage
fy=steel yield strength
fc'=concrete cylindrical strength at 28 days
ϕ=0.9

Deflection limitations as governed by the limits stipulated in ACI-318 Code of Practice, Chapter 9. Other criteria like general detailing, cover to reinforcement etc. are as per ACI-318, Chapter 7. Local code requirements can be implemented keeping the ACI requirements as the minimum acceptable.

Notes:

"a" is the upper and lower flat surfaces 10, 15 dimension of the element 5.

"As" is the area of steel section used in reinforcement 30 of the element 5.

"d" is the direction from the bottom of steel reinforcement 30 to the element upper surface 10.

A number of structural design tables have been formulated to provide alternatives of cross sectional dimensions, reinforcement, lengths and load bearing capacity. The tables located herein on pages 12 to 16 enable the user to choose the optimum dimensions of the cross section 17 and the length of the element 5. From the tables it can be seen that the linear metre weight of a single element, the load bearing capacity, the square metre cost are prime factors dictating the choice of the required dimensions.

In a preferred embodiment, steel bars 30 can be used as reinforcing bars for the reinforcement of the element 5. The diameter of the steel bars 30 and the passage 25 could vary from 6 mm to 12 mm depending on the desired length of the bar and the required bearing capacity. In mechanized production pre-stressed steel reinforcement can be used, in which case the span and bearing capacity of the element can be increased without any addition in the raw material.

The elements are preferably able to be handled without the need for heavy equipment. The following table is based on a specific gravity of 2350 kg/cubic meter and illustrates the weights per length of a preferred form of the elements.

| Length | Weight in kg |
|---|---|
| 0.50 meter long | 04.90 |
| 1.00 meter long | 09.80 |
| 1.50 meter long | 13.70 |
| 2.00 meter long | 18.60 |
| 2.50 meter long | 24.50 |
| 3.00 meter long | 29.40 |
| 3.50 meter long | 34.30 |
| 4.00 meter long | 39.20 |
| 4.50 meter long | 44.10 |
| 5.00 meter long | 49.00 |

These elements also preferably have crushing strengths varying between 25 K e.g. for walls to 40 K as in roof slabs. In this regard, the physical characteristics of the ingredients; sand, gravel, cement, water and the weather temperature are basic contributors to the mix. In most cases, the crushing strength of the concrete will be the decisive factor in identifying the various proportions of the mix. The Table below sets out the concrete mix used for building the pilot project.

TABLE 1

Concrete Mix Design For The Pilot Project
Type of concrete K40
Type of cement OPC.
Type of mix PRODUCTION

| Materials | Aggregate % - SSD | Vol. Ltrs | Spec Gravel vma | SSD Weight kg | Natural Moist % | Water Absorp % | Correct Weight kg |
|---|---|---|---|---|---|---|---|
| Cement | | 143 | 3.15 | 450 | | | 450 |
| Water | | 185 | 1 | 185 | | | 173 |
| Admixture | | | 1.11 | 12.77 | | | 13 |
| Air | | 10 | | | | | |
| Fine Aggregate (Sand) | | 268 | 2.61 | 700 | 5 | 1 | 728 |
| Coarse Aggregate | | | | | | | |
| ¾" | | | 2.7 | | | 1.5 | |
| ½" | | 196 | 2.7 | 530 | | 1.5 | 522 |
| ⅜" | | 204 | 2.7 | 550 | | 1.5 | 542 |
| TOTAL | 100% | 1018 | | 2428 | | | 2428 |

Figure 1D:
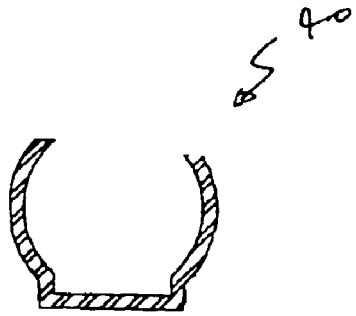

Turning now to the mode of production of the element 5, manual and mechanised methods are presently contemplated. The manual production is well suited for a limited production of the elements. For an individual, wishing to construct his/her own home unit, the means and the process of production are dependent upon moulds 40, shown in FIGS. 1*c* and 1*d* and are made out of material that allows multiple use and minimal deterioration.

Elements 5 could be produced as follows: procurement or fabrication of moulds 40; arranging moulds in batteries: placing reinforcing bars 30; mixing concrete; placing concrete in the mould 40 and vibrating as per standards; casting the reinforced concrete; curing and storing. As, preferably, the invention is intended to minimize the cost of reinforced concrete elements, it is important that the mould material is obtainable and that moulds fabricated from such material can be readily used without deterioration. The most suitable materials found for the purpose are GRC or GRP or PVC or polyethylene moulds cast to the form. The PVC or polyethylene moulds are made in one piece and, because the mould is flexible, it allows casting of formwork without disturbing the moulds and/or the elements and easy removal of the mould after use.

Generally, moulds 40 are arranged on specially prepared level casting floors, reinforcement is set in position, concrete is mixed and then cast into the moulds. Small size vibrators may be used to vibrate the concrete. The concrete should be retained in the moulds for a period of about three days, during which time the concrete will be cured. The elements could then be removed from the moulds and stacked for future use. The moulds can then be rearranged for another cast If reinforcement is required the reinforcing bars are laid in the mould and suspended in the required position by means of thin tie wires (not shown) or other suitable means. The wires keep the reinforcing bars properly positioned while the concrete mix is poured. The reinforcing bars should protrude beyond the ends of the moulds. The reinforcing could also be added later by casting a recess as in the preferred embodiment.

Another presently contemplated mode of production is the mechanized mode where the elements are produced on mass in a factory. Any practical length and width is possible only being limited by the length and width of the machines and the casting bed. The factory setup can be similar to the production line of hollow core slabs. The same principles of mixing, handling and casting of concrete apply. That is, it can be a concrete extrusion operation. The reinforcing bars for the element can be either normal tension bars or pre-stressed bars. In the preferred embodiment of this invention normal reinforcing bars are used. In the case of mass production for wide scale commercial purposes, the elements can be produced in slabs of various widths and lengths. The slabs can range from 1 meter in length up to 5 meters and the width is anywhere between 0.6 meters wide to 2 meters wide. All dimensions will generally be limited only by the deflection allowable in relation to the length of the slabs. The elements can be stacked in a storage yard and sold on order. This allows spontaneous delivery of required material thus contributing to substantial reduction in construction time.

Figure 1B:
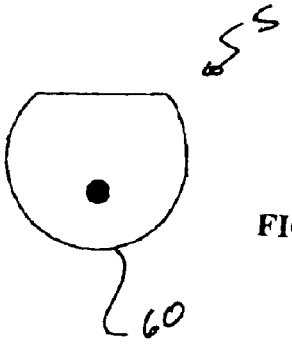
FIGS. 1*a* and 1*b* are cross-sectional views of two alternate embodiments of the element according to the present invention.
Figure 1A:
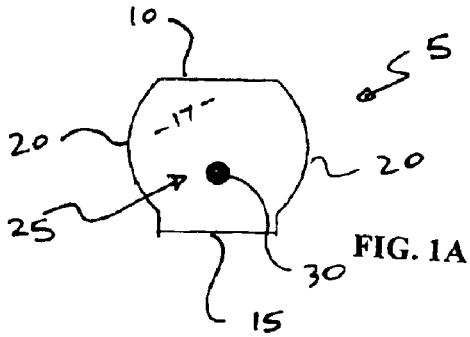
Figures 1E, 1F, 1G:
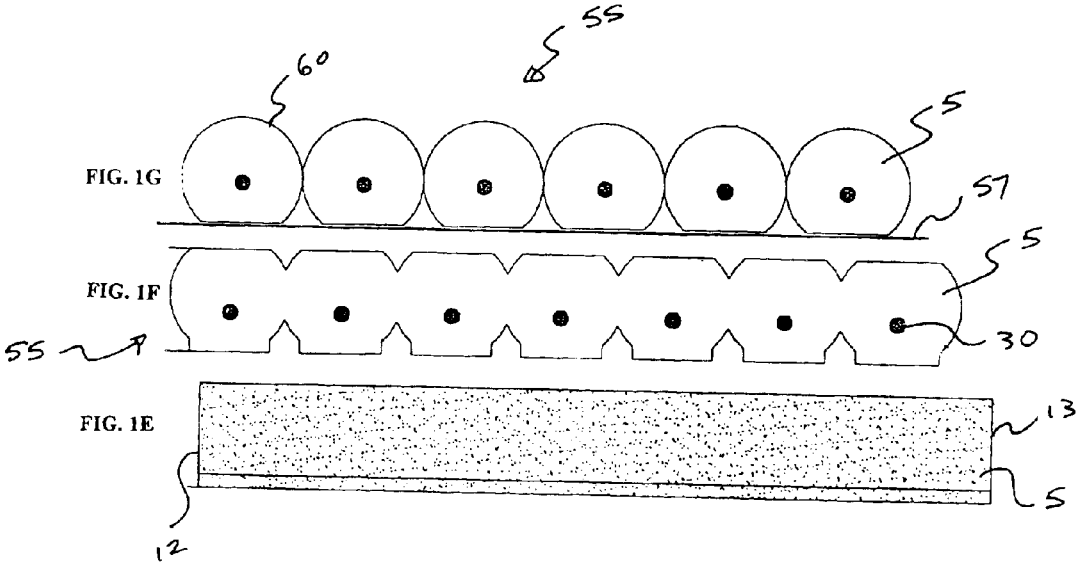
FIG. 1*e* is a side view of an element.
FIGS. 1*f* and 1*g* are side views of a series of elements in accordance with FIGS. 1*a* and 1*b* forming a slab.
Figures 1H, 1I, 1J:
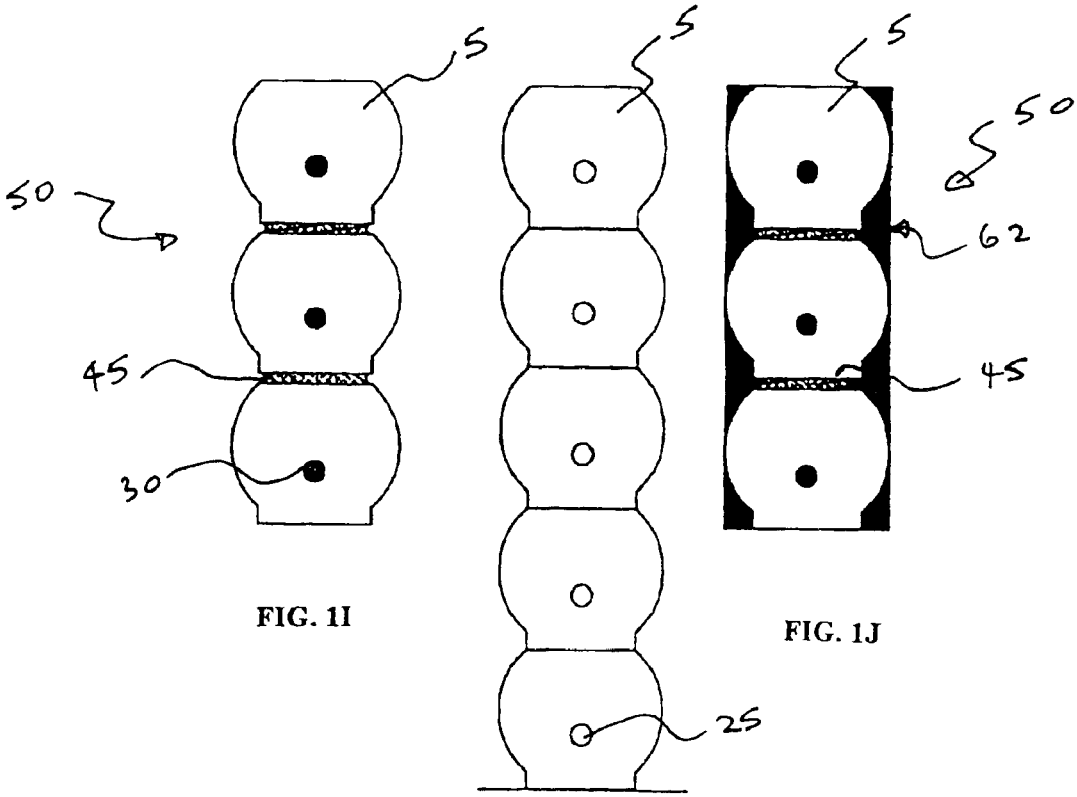
FIG. 1*h* is a side view of a series of elements in accordance with FIG. 1*a*, forming a free standing wall.
FIG. 1*i* is a side view of a series of elements in accordance with FIG. 1*a*, forming a wall where the elements are cemented together.
FIG. 1*j* is a side view of a series of elements in accordance with FIG. 1*a*, forming a plastered wall.
Figure 2:
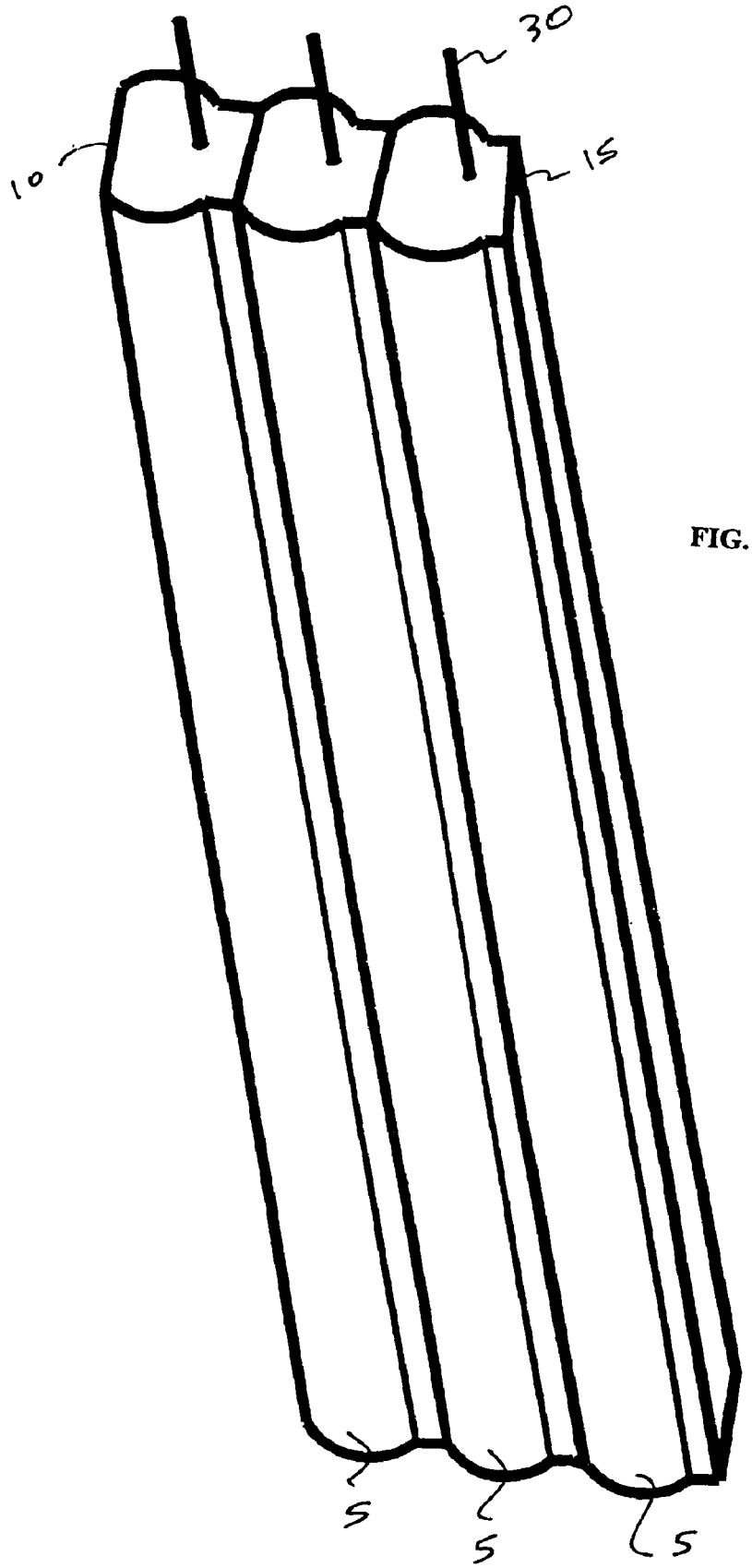
FIG. 2 is a perspective view of a series of elements in accordance with FIG. 1*a*.

There are two main uses presently contemplated for the elements 5; constructing walls 50 and structural slabs 55. In the first case, and as shown in FIGS. 1*h* to 1*j*, the elements 5 can be assembled with or without mortar/cement 45, depending on the final treatment of the walls 50. For the slabs 55, as shown in FIG. 1*g*, the elements 5 can be built on structural frames 57 and either cast in place, pre-cast or a steel frame. After arranging the elements 5 in place, a concrete topping 59 (see FIGS. 3 and 4) could be poured to the thickness required. Further, as shown in FIGS. 1B and 1G the upper surface may be rounded 60.

Figure 3:
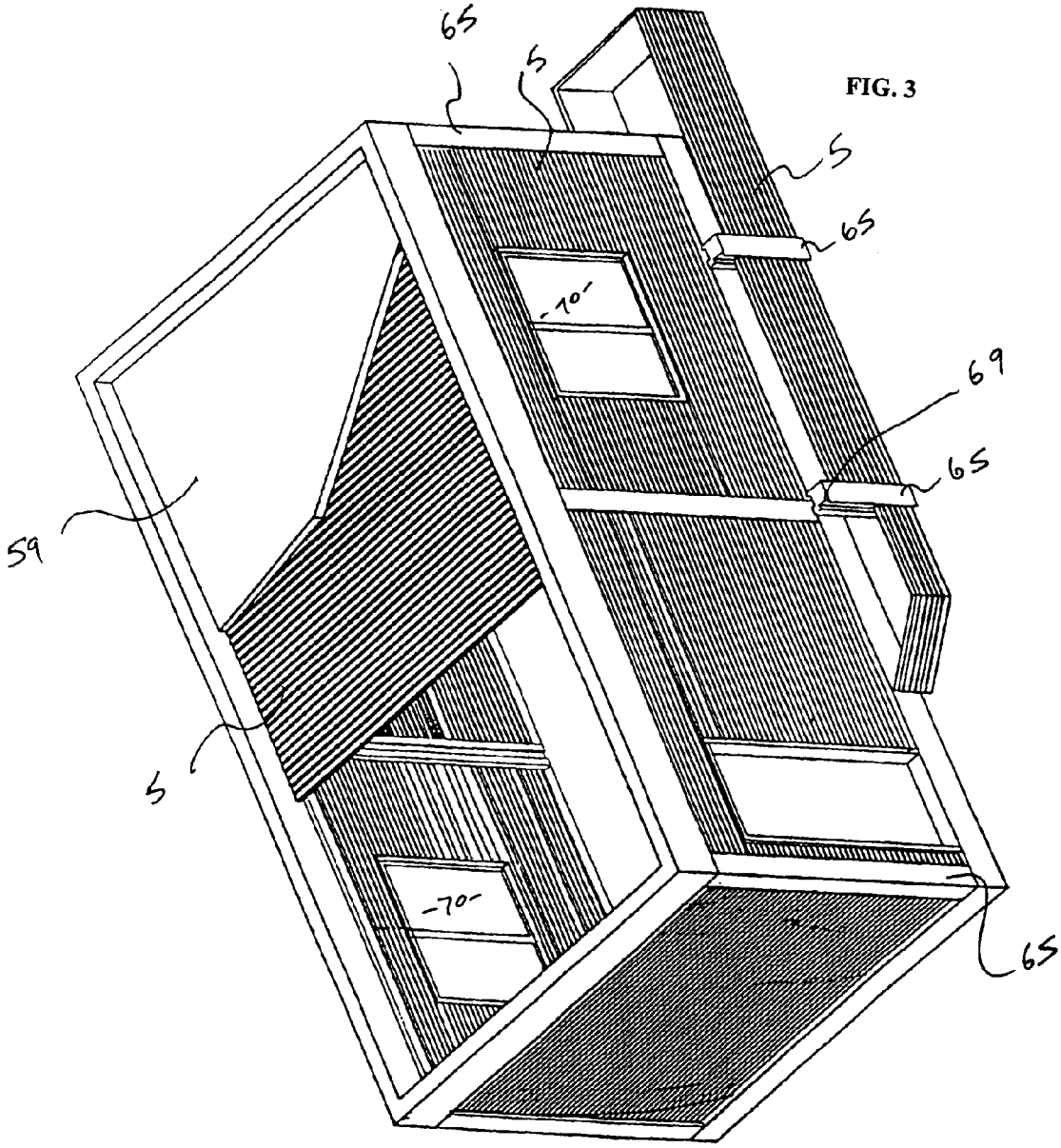
FIG. 3 is a partial 3-dimensional view of a house showing use of a series of elements.
Figure 4:
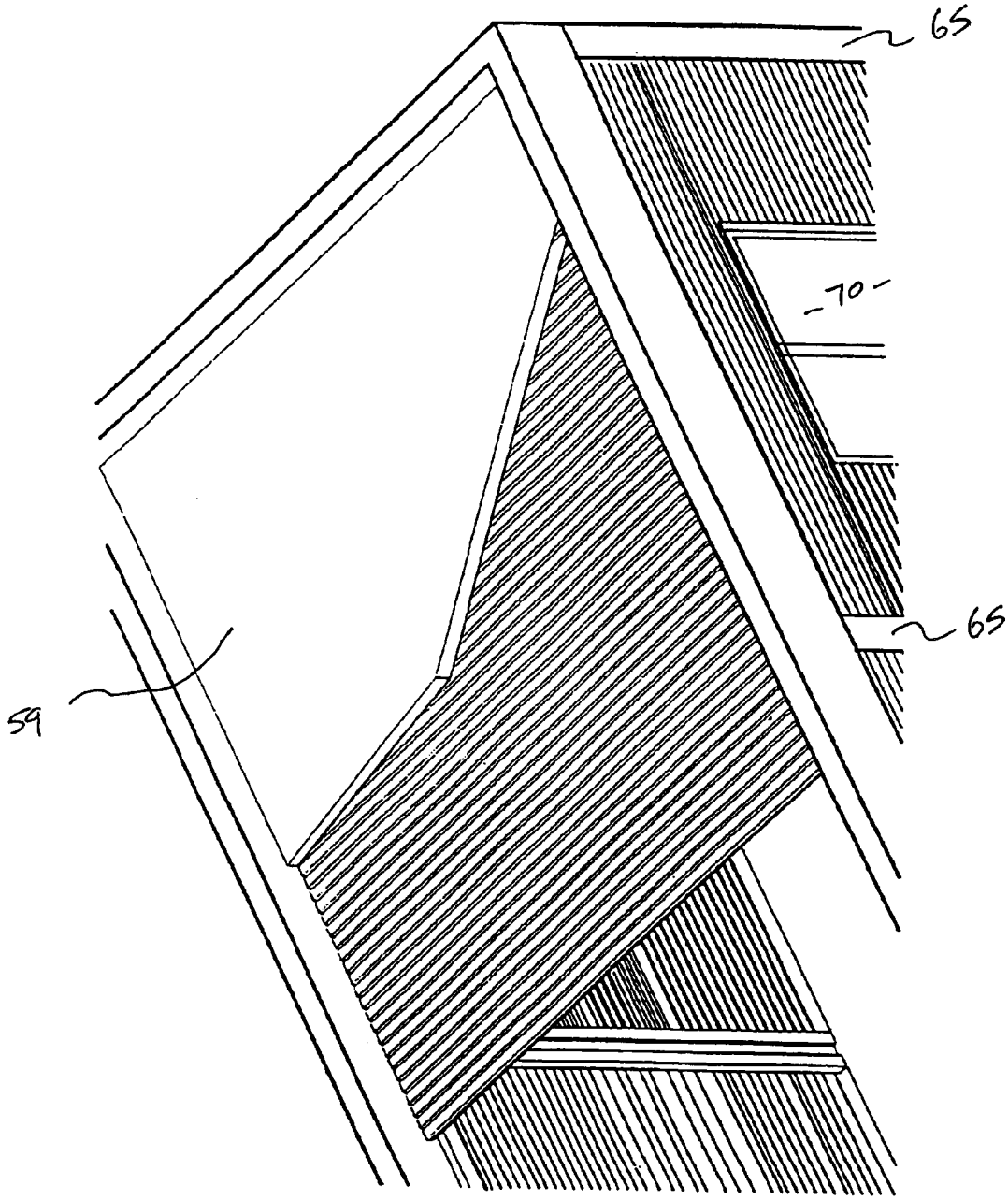
FIG. 4 is a partial 3-dimensional cut away view of the roof of the house of FIG. 3.

As shown in FIGS. 1*h* to 1*j*, when constructing wall 50 the elements 5 stacked vertically, with or without mortar 45. The elements 5 can be restrained on both horizontal ends by concrete columns 65 as shown in FIGS. 3 and 4. The elements 5 are then laid therebetween, either dry or with mortar 45 one on top of the other. In this arrangement, the upper surface 10 on top of the element 5 will act as a base for the following element 5. Dry construction of the elements 5 in walls 50 will usually include plaster 62 on the outside in order to weather tighten the walls 50. Further, casting the concrete framing columns 65 on site after building the elements 5 will allow an integral structural bonding between the elements 5 and the frame. This adds substantial structural rigidity to the building frame. If, however, the columns 65 are built in situ ahead of the elements 5, then the elements 5 will have to be bonded to the columns 65 by means of mortar 45. Enough space for this procedure can be provided by placing a pre-moulded groove 69 in the column to allow for the bonding mortar.

In embodiments including housing construction, windows 70 may be opened in the wall 50 simply by casting the elements 5 to the specific dimensions required to allow the window opening to be formed. The elements can be cut to size on site or better pre-fabricated to the required lengths. No special framing system is required for the windows and no lintels will be needed. The elements once plastered will produce the required window frame thickness. Depending on the insulation standards required for the building, the necessary insulation material is constructed. Alternatively if the insulation of the exterior is not required, the inner face may be left without any treatment and/or may be plastered to produce a good internal finish face with plaster and paint as per the standard practice. Depending upon the design requirements, the exterior walls can be clad with marble, stone, granite, bricks or can be plastered and painted.

It is also foreshadowed that elements can be used as internal partitions too. Further, about 15 millimetres of plaster on each side of the partition will produce a 100 mm thick partition wall.

If considering structural slabs 55, as shown in FIGS. 1*e* to 1*g*, based on the slab plans and the finishing beneath the slabs, the length and the reinforcement of the elements 5 are decided; all fabrication of the elements should be to the pre-designed, required length. Moreover, cutting the elements to the required length on site is easy and can be achieved by means of an electric disc saw. The elements 5 are laid horizontally to the full length and width of the slab area. If the clear span between the two end supports of the element is more than 2.5 metres, an intermediary support should be temporarily provided until the plain concrete slab topping 59 of the elements 5 is poured and cured.

Further to the above, the elements 5 can be used in fencing posts and runners; warehouse wall closure; warehouse roof trusses; shoring panels closing between vertical structural supports; pavements substructures; and fruit trees groves and vineyards, however, they are not limited to only these uses.

As cost is important in the construction industry the following table and figures draw a comparative analysis between the elements of the present invention at least in a preferred embodiment and other concrete products, emphasising the economic implications.

TABLE A

Walls and Slab Analysis

| Description | Linear Metre | Square Metre | Steel Reinforcement | US$ |
|---|---|---|---|---|
| Concrete and steel content in one element. | 0.00417 mc/lm | Walls 0.063 cm/sqm Slabs 0.055 cm/sqm | @6 mm 0.226 kg/lm 3.01 kg/sm. 54.87 kg/cm | 6.78/sqm of Walls 107.20/cm of Walls |
| 1 cubic metre concrete. | 240 lm. | Walls @ 15.80 sq m./cm Slabs @ 18.00 sq m/cm | @8 mm 0.40 kg/lm 5.35 kg/sq m. 97.556 kg/cm | 10.00/sqm Slabs 180.00/cm in Slabs including 80 mm/sqm thickness concrete topping of plain concrete topping |
| 1 cubic metre in concrete blocks 10*20*40. | Not applicable | 12.50 units 13.40/cm | Not applicable | 11.00/sq m. |
| 1 cubic metre in reinforced concrete slab, average thickness 12 cm. | Not applicable | 8.33 sq m/cm | | 196.8.00/cm 23.60/sq m. |

Upon analysis of the above table it can be seen that, walls constructed using the elements of the present invention cost 61.60% of the standard 100 mm thick sand cement blocks and slabs cost 42.37% of the standard 120 mm thick reinforced concrete slabs.

The cost analysis of one cubic meter displayed in the table (cost is calculated on basis of Kuwait market prices) was calculated as follows:

| | |
|---|---|
| Concrete material | $42.00 |
| Reinforced steel 55 kg. @ $249/Metric Ton | $13.69 |
| Allow for casting, curing and transport to site | $15.00 |
| Allow for site handling and construction in walls | $15.00 |
| Sub-total cost/cubic Metre: | $85.69 |
| Add 25% for overhead and profit | $21.42 |
| Total cost/cubic metre | $107.20. |

Further differences with the present invention is that normal block work construction is a "wet" trade whilst the present invention is a "dry" trade. This minimises the messiness on sites and will save on water consumption. Most block work requires plastering. The elements of the present invention can stay without plaster on the interior, for example, when providing for low cost housing, and still maintain an aesthetically acceptable look. Further, block work requires seven days curing time before it is allowed to be plastered whilst the elements can be plastered instantly. Still further, the transportation and mechanical handling costs are also reduced when simply considering that light and less material will be transported.

Further, when constructing slabs the labour rate for carpenters forming slabs is estimated at a minimum of US$42.80 per cubic metre and this is eliminated with the elements of the present invention. The need for wood and other sundries for formwork at US$ 18 per cubic metre is also preferably eliminated. A minimum of 30% of the concrete used in similar span solid slabs will be reduced by one third, yielding a saving in concrete quantity and in reinforcement of US$35.00/cubic metre. Total direct saving of labour, formwork and the reduction in quantities in slab concrete and reinforcement steel is US$95.80. This will produce a yield saving of approximately 64% of the prevailing cost of cubic metre of concrete of the classical slab system.

In consideration of the substantial direct savings mentioned above, there is an indirect saving effect that results from the reduction in the concrete and reinforcement quantities and the dead load. A proportional reduction to the foundation and the framing structure will result from the elimination of dead weights on walls and on slabs. This will yield a minimum saving of 25% of the concrete and reinforcement value for the foundations and the framing of the structure. It is contemplated that there would be US$15.00 per cubic metre in the foundation and the framing system.

As reinforced concrete is globally considered one of the most utilised material in the construction industry and is also expensive to acquire in its final form, people in the low-income bracket would be substantially advantaged to use such a product.

The element of the present invention is directed towards a segment of the world's population by giving them a cost-effective and economically viable solution in order to address the cost issues and the difficulties involved in advanced technology. It does not eliminate all the problems but makes the solution much more attainable by the end user. It provides a standard solution to the construction of walls and slabs in any standard structure and in particular modular structures. The fact that the formwork for slabs, and in many parts of the world for wall construction, is relatively eliminated, a major saving on the use of wood for concrete construction purposes is achieved. This, on its own merit, will reflect positively on the issue of world forestry depletion.

Although the invention has been described with reference to specific examples, it would be appreciated by those skilled in the art that the invention may be embodied in many other forms.

TABLE 1 section properties

| | | | | |
|---|---|---|---|---|
| | diame | | 7.51 | |
| | depth | | 6.4 | |
| x | y | dA | dA.x | dA.x2 |
| 0.00 | 0.00 | 0.0 | 0.0 | 0.0 |
| 0.16 | 2.17 | 0.3 | 0.1 | 0.0 |
| 0.32 | 3.03 | 0.5 | 0.2 | 0.0 |
| 0.48 | 3.67 | 0.6 | 0.3 | 0.1 |
| 0.64 | 4.19 | 0.7 | 0.4 | 0.3 |
| 0.80 | 4.63 | 0.7 | 0.6 | 0.5 |
| 0.96 | 5.02 | 0.8 | 0.8 | 0.7 |
| 1.12 | 5.35 | 0.9 | 1.0 | 1.1 |
| 1.28 | 5.65 | 0.9 | 1.2 | 1.5 |
| 1.44 | 5.91 | 0.9 | 1.4 | 2.0 |
| 1.60 | 6.15 | 1.0 | 1.6 | 2.5 |
| 1.76 | 6.36 | 1.0 | 1.8 | 3.2 |
| 1.92 | 6.55 | 1.0 | 2.0 | 3.9 |
| 2.08 | 6.72 | 1.1 | 2.2 | 4.7 |
| 2.24 | 6.87 | 1.1 | 2.5 | 5.5 |
| 2.40 | 7.00 | 1.1 | 2.7 | 6.5 |
| 2.56 | 7.12 | 1.1 | 2.9 | 7.5 |
| 2.72 | 7.22 | 1.2 | 3.1 | 8.5 |
| 2.88 | 7.30 | 1.2 | 3.4 | 9.7 |
| 3.04 | 7.37 | 1.2 | 3.6 | 10.9 |
| 3.20 | 7.43 | 1.2 | 3.8 | 12.2 |
| 3.36 | 7.47 | 1.2 | 4.0 | 13.5 |
| 3.52 | 7.50 | 1.2 | 4.2 | 14.9 |
| 3.68 | 7.51 | 1.2 | 4.4 | 16.3 |
| 3.84 | 7.51 | 1.2 | 4.6 | 17.7 |
| 4.00 | 7.49 | 1.2 | 4.8 | 19.2 |
| 4.16 | 7.47 | 1.2 | 5.0 | 20.7 |
| 4.32 | 7.42 | 1.2 | 5.1 | 22.2 |
| 4.48 | 7.37 | 1.2 | 5.3 | 23.7 |
| 4.64 | 7.30 | 1.2 | 5.4 | 25.1 |
| 4.80 | 7.21 | 1.2 | 5.5 | 26.6 |
| 4.96 | 7.11 | 1.1 | 5.6 | 28.0 |
| 5.12 | 7.00 | 1.1 | 5.7 | 29.3 |
| 5.28 | 6.86 | 1.1 | 5.8 | 30.6 |
| 5.44 | 6.71 | 1.1 | 5.8 | 31.8 |
| 5.60 | 6.54 | 1.0 | 5.9 | 32.8 |
| 5.76 | 6.35 | 1.0 | 5.9 | 33.7 |
| 5.92 | 6.14 | 1.0 | 5.8 | 34.4 |
| 6.08 | 5.90 | 0.9 | 5.7 | 34.9 |
| 6.24 | 5.63 | 0.9 | 5.6 | 35.1 |
| 6.40 | 5.33 | 0.9 | 5.5 | 34.9 |
| | | 40.6 | 141.1 | 606.4 |

| | | |
|---|---|---|
| Area | 40.6 | cm2 |
| xbar | 3.48 | cm |
| I xbar | 115.6 | cm4 |
| top w | 5.33 | cm |
| w avr. | 6.81 | cm |
| fc | 240 | kg/cm2 |
| beta | 0.85 | |
| Fy | 4200 | kg/cm2 |
| Ec | 248646 | kg/cm2 |
| n | 8.04 | |
| cover | 2 | cm |
| Mcr | 1024.9 | kg-cm |

TABLE 2

Maximum Element Span Before Cracking

| diam | x | lcr | Muc | Mu | Ms | span | le | le/lg | defl. |
|---|---|---|---|---|---|---|---|---|---|
| 0.6 | 0.00 | 38.2 | 5649 | 3864 | 2760 | 576 | 39.5 | 0.34 | 2.1 |
| 0.8 | 0.00 | 64.7 | 5377 | 5964 | 3841 | 562 | 65.7 | 0.57 | 1.1 |

TABLE 2-continued

| | | Maximum Element Span Before Cracking | | | | | | | |
|---|---|---|---|---|---|---|---|---|---|
| diam | x | lcr | Muc | Mu | Ms | span | le | le/lg | defl. |
| 1.0 | 0.00 | 96.1 | 5111 | 7583 | 3651 | 548 | 96.5 | 0.83 | 0.7 |
| 1.2 | 0.00 | 131.4 | 4853 | 7960 | 3466 | 534 | 131.0 | 1.13 | 0.5 |

TABLE 3

| | | Variation of Reinforcement Steel Diameter, Concrete Topping, Element Length, Allowable and Actual Deflection and Load Bearing Limit | | | | | | | | |
|---|---|---|---|---|---|---|---|---|---|---|
| diam | topp | span | Muc | Mu | Ms | ttl cap. | ld cap. | defl. | def lmt | LIMIT CPCTY |
| 0.6 | 5 | 500 | 27829 | 9208 | 6577 | 280.3 | 26.0 | 1.9 | 2.50 | 25.99 |
| 0.8 | 5 | 500 | 27220 | 15464 | 11046 | 470.6 | 216.4 | 3.1 | 2.50 | 122.96 |
| 1.0 | 5 | 500 | 26619 | 22427 | 16019 | 682.6 | 428.3 | 4.5 | 2.50 | 122.96 |
| 1.2 | 5 | 500 | 26024 | 29335 | 18589 | 792.1 | 537.8 | 5.2 | 2.50 | 122.96 |
| 0.6 | 6 | 500 | 34281 | 10277 | 7341 | 312.8 | 34.5 | 1.6 | 2.50 | 34.52 |
| 0.8 | 6 | 500 | 33605 | 17364 | 12403 | 528.5 | 250.2 | 2.7 | 2.50 | 207.19 |
| 1.0 | 6 | 500 | 32937 | 25396 | 18140 | 772.9 | 494.7 | 4.0 | 2.50 | 207.19 |
| 1.2 | 6 | 500 | 32275 | 33611 | 23053 | 982.3 | 704.0 | 5.1 | 2.50 | 207.19 |
| 0.6 | 7 | 500 | 41405 | 11346 | 8104 | 345.3 | 43.0 | 1.4 | 2.50 | 43.05 |
| 0.8 | 7 | 500 | 40662 | 19264 | 13760 | 586.3 | 284.0 | 2.4 | 2.50 | 284.05 |
| 1.0 | 7 | 500 | 39926 | 28364 | 20260 | 863.3 | 561.0 | 3.5 | 2.50 | 310.37 |
| 1.2 | 7 | 500 | 39197 | 37886 | 27061 | 1153.1 | 850.8 | 4.7 | 2.50 | 310.37 |
| 0.6 | 8 | 500 | 49202 | 12414 | 8867 | 377.8 | 51.6 | 1.2 | 2.50 | 51.58 |
| 0.8 | 8 | 500 | 48392 | 21164 | 15117 | 644.1 | 317.9 | 2.1 | 2.50 | 317.87 |
| 1.0 | 8 | 500 | 47588 | 31333 | 22381 | 953.6 | 627.4 | 3.1 | 2.50 | 434.01 |
| 1.2 | 8 | 500 | 46792 | 42161 | 30115 | 1283.2 | 956.9 | 4.2 | 2.50 | 434.01 |
| 0.6 | 9 | 500 | 57670 | 13483 | 9631 | 410.4 | 60.1 | 1.1 | 2.50 | 60.10 |
| 0.8 | 9 | 500 | 56793 | 23064 | 16474 | 702.0 | 351.7 | 1.9 | 2.50 | 351.70 |
| 1.0 | 9 | 500 | 55923 | 34302 | 24501 | 1044.0 | 693.7 | 2.8 | 2.50 | 579.66 |
| 1.2 | 9 | 500 | 55059 | 46436 | 33168 | 1413.3 | 1063.0 | 3.8 | 2.50 | 579.66 |
| 0.6 | 10 | 500 | 66811 | 14552 | 10394 | 442.9 | 68.6 | 1.0 | 2.50 | 68.63 |
| 0.8 | 10 | 500 | 65866 | 24964 | 17831 | 759.8 | 385.5 | 1.7 | 2.50 | 385.53 |
| 1.0 | 10 | 500 | 64929 | 37271 | 26622 | 1134.4 | 760.1 | 2.5 | 2.50 | 748.83 |
| 1.2 | 10 | 500 | 63998 | 50711 | 36222 | 1543.4 | 1169.2 | 3.4 | 2.50 | 748.83 |
| 0.6 | 5 | 450 | 27829 | 9208 | 6577 | 346.0 | 91.7 | 1.5 | 2.25 | 91.73 |
| 0.8 | 5 | 450 | 27220 | 15464 | 11046 | 581.0 | 326.8 | 2.5 | 2.25 | 263.19 |
| 1.0 | 5 | 450 | 26619 | 22427 | 16019 | 842.7 | 588.4 | 3.7 | 2.25 | 263.19 |
| 1.2 | 5 | 450 | 26024 | 29335 | 18589 | 977.8 | 723.6 | 4.3 | 2.25 | 263.19 |
| 0.6 | 6 | 450 | 34281 | 10277 | 7341 | 386.1 | 107.9 | 1.3 | 2.25 | 107.89 |
| 0.8 | 6 | 450 | 33605 | 17364 | 12403 | 652.4 | 374.2 | 2.2 | 2.25 | 374.18 |
| 1.0 | 6 | 450 | 32937 | 25396 | 18140 | 954.2 | 676.0 | 3.2 | 2.25 | 387.66 |
| 1.2 | 6 | 450 | 32275 | 33611 | 23053 | 1212.7 | 934.4 | 4.1 | 2.25 | 387.66 |
| 0.6 | 7 | 450 | 41405 | 11346 | 8104 | 426.3 | 124.0 | 1.1 | 2.25 | 124.05 |
| 0.8 | 7 | 450 | 40662 | 19264 | 13760 | 723.8 | 421.6 | 1.9 | 2.25 | 421.57 |
| 1.0 | 7 | 450 | 39926 | 28364 | 20260 | 1065.8 | 763.5 | 2.9 | 2.25 | 538.11 |
| 1.2 | 7 | 450 | 39197 | 37886 | 27061 | 1423.5 | 1121.3 | 3.8 | 2.25 | 538.11 |
| 0.6 | 8 | 450 | 49202 | 12414 | 8867 | 466.5 | 140.2 | 1.0 | 2.25 | 140.20 |
| 0.8 | 8 | 450 | 48392 | 21164 | 15117 | 795.2 | 469.0 | 1.7 | 2.25 | 468.97 |
| 1.0 | 8 | 450 | 47588 | 31333 | 22381 | 1177.3 | 851.1 | 2.5 | 2.25 | 716.64 |
| 1.2 | 8 | 450 | 46792 | 42161 | 30115 | 1584.2 | 1257.9 | 3.4 | 2.25 | 716.64 |
| 0.6 | 5 | 400 | 27829 | 9208 | 6577 | 437.9 | 183.6 | 1.2 | 2.00 | 183.63 |
| 0.8 | 5 | 400 | 27220 | 15464 | 11046 | 735.4 | 481.1 | 2.0 | 2.00 | 481.13 |
| 1.0 | 5 | 400 | 26619 | 22427 | 16019 | 1066.5 | 812.3 | 2.9 | 2.00 | 482.50 |
| 1.2 | 5 | 400 | 26024 | 29335 | 18589 | 1237.6 | 983.3 | 3.4 | 2.00 | 482.50 |
| 0.6 | 6 | 400 | 34281 | 10277 | 7341 | 488.7 | 210.5 | 1.0 | 2.00 | 210.46 |
| 0.8 | 6 | 400 | 33605 | 17364 | 12403 | 825.7 | 547.5 | 1.7 | 2.00 | 547.48 |
| 1.0 | 6 | 400 | 32937 | 25396 | 18140 | 1207.7 | 929.4 | 2.5 | 2.00 | 669.89 |
| 1.2 | 6 | 400 | 32275 | 33611 | 23053 | 1534.8 | 1256.6 | 3.2 | 2.00 | 669.89 |
| 0.6 | 7 | 400 | 41405 | 11346 | 8104 | 539.5 | 237.3 | 0.9 | 2.00 | 237.28 |
| 0.8 | 7 | 400 | 40662 | 19264 | 13760 | 916.1 | 613.8 | 1.5 | 2.00 | 613.84 |
| 1.0 | 7 | 400 | 39926 | 28364 | 20260 | 1348.9 | 1046.6 | 2.3 | 2.00 | 894.28 |
| 1.2 | 7 | 400 | 39197 | 37886 | 27061 | 1801.7 | 1499.4 | 3.0 | 2.00 | 894.28 |
| 0.6 | 8 | 400 | 49202 | 12414 | 8867 | 590.4 | 264.1 | 0.8 | 2.00 | 264.11 |
| 0.8 | 8 | 400 | 48392 | 21164 | 15117 | 1006.5 | 680.2 | 1.4 | 2.00 | 680.20 |
| 1.0 | 8 | 400 | 47588 | 31333 | 22381 | 1490.1 | 1163.8 | 2.0 | 2.00 | 1158.65 |
| 1.2 | 8 | 400 | 46792 | 42161 | 30115 | 2005.0 | 1678.7 | 2.7 | 2.00 | 1158.65 |
| 0.6 | 5 | 350 | 27829 | 9208 | 6577 | 571.9 | 317.7 | 0.9 | 1.75 | 317.68 |
| 0.8 | 5 | 350 | 27220 | 15464 | 11046 | 960.5 | 706.2 | 1.5 | 1.75 | 706.25 |

TABLE 3-continued

Variation of Reinforcement Steel Diameter, Concrete Topping, Element Length, Allowable and Actual Deflection and Load Bearing Limit

| diam | topp | span | Muc | Mu | Ms | ttl cap. | ld cap. | defl. | def lmt | LIMIT CPCTY |
|---|---|---|---|---|---|---|---|---|---|---|
| 1.0 | 5 | 350 | 26619 | 22427 | 16019 | 1393.0 | 1138.7 | 2.2 | 1.75 | 845.51 |
| 1.2 | 5 | 350 | 26024 | 29335 | 18589 | 1616.4 | 1362.2 | 2.6 | 1.75 | 845.51 |
| 0.6 | 6 | 350 | 34281 | 10277 | 7341 | 638.3 | 360.1 | 0.8 | 1.75 | 360.06 |
| 0.8 | 6 | 350 | 33605 | 17364 | 12403 | 1078.5 | 800.3 | 1.3 | 1.75 | 800.26 |
| 1.0 | 6 | 350 | 32937 | 25396 | 18140 | 1577.4 | 1299.1 | 2.0 | 1.75 | 1137.05 |
| 1.2 | 6 | 350 | 32275 | 33611 | 23053 | 2004.7 | 1726.4 | 2.5 | 1.75 | 1137.05 |
| 0.6 | 7 | 350 | 41405 | 11346 | 8104 | 704.7 | 402.4 | 0.7 | 1.75 | 402.45 |
| 0.8 | 7 | 350 | 40662 | 19264 | 13760 | 1196.5 | 894.3 | 1.2 | 1.75 | 894.28 |
| 1.0 | 7 | 350 | 39926 | 28364 | 20260 | 1761.8 | 1459.6 | 1.7 | 1.75 | 1459.55 |
| 1.2 | 7 | 350 | 39197 | 37886 | 27061 | 2353.2 | 2050.9 | 2.3 | 1.75 | 1483.82 |
| 0.6 | 8 | 350 | 49202 | 12414 | 8867 | 771.1 | 444.8 | 0.6 | 1.75 | 444.83 |
| 0.8 | 8 | 350 | 48392 | 21164 | 15117 | 1314.6 | 988.3 | 1.0 | 1.75 | 988.30 |
| 1.0 | 8 | 350 | 47588 | 31333 | 22381 | 1946.2 | 1620.0 | 1.5 | 1.75 | 1619.95 |
| 1.2 | 8 | 350 | 46792 | 42161 | 30115 | 2618.7 | 2292.5 | 2.1 | 1.75 | 1890.28 |
| 0.6 | 5 | 300 | 27829 | 9208 | 6577 | 778.5 | 524.2 | 0.7 | 1.50 | 524.21 |
| 0.8 | 5 | 300 | 27220 | 15464 | 11046 | 1307.4 | 1053.1 | 1.1 | 1.50 | 1053.10 |
| 1.0 | 5 | 300 | 26619 | 22427 | 16019 | 1896.0 | 1641.8 | 1.6 | 1.50 | 1492.13 |
| 1.2 | 5 | 300 | 26024 | 29335 | 18589 | 2200.2 | 1945.9 | 1.9 | 1.50 | 1492.13 |
| 0.6 | 6 | 300 | 34281 | 10277 | 7341 | 868.8 | 590.6 | 0.6 | 1.50 | 590.57 |
| 0.8 | 6 | 300 | 33605 | 17364 | 12403 | 1468.0 | 1189.7 | 1.0 | 1.50 | 1189.73 |
| 1.0 | 6 | 300 | 32937 | 25396 | 18140 | 2147.0 | 1868.8 | 1.4 | 1.50 | 1868.77 |
| 1.2 | 6 | 300 | 32275 | 33611 | 23053 | 2728.6 | 2450.3 | 1.8 | 1.50 | 1969.20 |
| 0.6 | 7 | 300 | 41405 | 11346 | 8104 | 959.2 | 656.9 | 0.5 | 1.50 | 656.93 |
| 0.8 | 7 | 300 | 40662 | 19264 | 13760 | 1628.6 | 1326.4 | 0.9 | 1.50 | 1326.37 |
| 1.0 | 7 | 300 | 39926 | 28364 | 20260 | 2398.0 | 2095.8 | 1.3 | 1.50 | 2095.76 |
| 1.2 | 7 | 300 | 39197 | 37886 | 27061 | 3203.0 | 2900.7 | 1.7 | 1.50 | 2533.97 |
| 0.6 | 8 | 300 | 49202 | 12414 | 8867 | 1049.5 | 723.3 | 0.4 | 1.50 | 723.29 |
| 0.8 | 8 | 300 | 48392 | 21164 | 15117 | 1789.3 | 1463.0 | 0.8 | 1.50 | 1463.00 |
| 1.0 | 8 | 300 | 47588 | 31333 | 22381 | 2649.0 | 2322.8 | 1.1 | 1.50 | 2322.75 |
| 1.2 | 8 | 300 | 46792 | 42161 | 30115 | 3564.4 | 3238.1 | 1.5 | 1.50 | 3193.52 |
| 0.6 | 5 | 250 | 27829 | 9208 | 6577 | 1121.0 | 866.7 | 0.5 | 1.25 | 866.74 |
| 0.8 | 5 | 250 | 27220 | 15464 | 11046 | 1882.6 | 1628.3 | 0.8 | 1.25 | 1628.33 |
| 1.0 | 5 | 250 | 26619 | 22427 | 16019 | 2730.3 | 2476.0 | 1.1 | 1.25 | 2476.03 |
| 1.2 | 5 | 250 | 26024 | 29335 | 18589 | 3168.2 | 2914.0 | 1.3 | 1.25 | 2763.51 |
| 0.6 | 6 | 250 | 34281 | 10277 | 7341 | 1251.1 | 972.9 | 0.4 | 1.25 | 972.86 |
| 0.8 | 6 | 250 | 33605 | 17364 | 12403 | 2113.9 | 1835.6 | 0.7 | 1.25 | 1835.65 |
| 1.0 | 6 | 250 | 32937 | 25396 | 18140 | 3091.7 | 2813.5 | 1.0 | 1.25 | 2813.46 |
| 1.2 | 6 | 250 | 32275 | 33611 | 23053 | 3929.2 | 3650.9 | 1.3 | 1.25 | 3605.36 |
| 0.6 | 7 | 250 | 41405 | 11346 | 8104 | 1381.2 | 1079.0 | 0.4 | 1.25 | 1078.97 |
| 0.8 | 7 | 250 | 40662 | 19264 | 13760 | 2345.2 | 2043.0 | 0.6 | 1.25 | 2042.96 |
| 1.0 | 7 | 250 | 39926 | 28364 | 20260 | 3453.2 | 3150.9 | 0.9 | 1.25 | 3150.89 |
| 1.2 | 7 | 250 | 39197 | 37886 | 27061 | 4612.3 | 4310.0 | 1.2 | 1.25 | 4310.03 |
| 0.6 | 8 | 250 | 49202 | 12414 | 8867 | 1511.3 | 1185.1 | 0.3 | 1.25 | 1185.09 |
| 0.8 | 8 | 250 | 48392 | 21164 | 15117 | 2576.5 | 2250.3 | 0.5 | 1.25 | 2250.28 |
| 1.0 | 8 | 250 | 47588 | 31333 | 22381 | 3814.6 | 3488.3 | 0.8 | 1.25 | 3488.32 |
| 1.2 | 8 | 250 | 46792 | 42161 | 30115 | 5132.7 | 4806.5 | 1.1 | 1.25 | 4806.49 |
| 0.6 | 5 | 200 | 27829 | 9208 | 6577 | 1751.6 | 1497.3 | 0.3 | 1.00 | 1497.31 |
| 0.8 | 5 | 200 | 27220 | 15464 | 11046 | 2941.5 | 2687.3 | 0.5 | 1.00 | 2687.29 |
| 1.0 | 5 | 200 | 26619 | 22427 | 16019 | 4266.1 | 4011.8 | 0.7 | 1.00 | 4011.82 |
| 1.2 | 5 | 200 | 26024 | 29335 | 18589 | 4950.3 | 4696.1 | 0.8 | 1.00 | 4696.08 |
| 0.6 | 6 | 200 | 34281 | 10277 | 7341 | 1954.9 | 1676.6 | 0.3 | 1.00 | 1676.61 |
| 0.8 | 6 | 200 | 33605 | 17364 | 12403 | 3303.0 | 3024.7 | 0.4 | 1.00 | 3024.72 |
| 1.0 | 6 | 200 | 32937 | 25396 | 18140 | 4830.8 | 4552.6 | 0.6 | 1.00 | 4552.55 |
| 1.2 | 6 | 200 | 32275 | 33611 | 23053 | 6139.3 | 5861.1 | 0.8 | 1.00 | 5861.08 |
| 0.6 | 7 | 200 | 41405 | 11346 | 8104 | 2158.2 | 1855.9 | 0.2 | 1.00 | 1855.91 |
| 0.8 | 7 | 200 | 40662 | 19264 | 13760 | 3664.4 | 3362.1 | 0.4 | 1.00 | 3362.15 |
| 1.0 | 7 | 200 | 39926 | 28364 | 20260 | 5395.5 | 5093.3 | 0.6 | 1.00 | 5093.29 |
| 1.2 | 7 | 200 | 39197 | 37886 | 27061 | 7206.7 | 6904.4 | 0.8 | 1.00 | 6904.44 |
| 0.6 | 8 | 200 | 49202 | 12414 | 8867 | 2361.5 | 2035.2 | 0.2 | 1.00 | 2035.22 |
| 0.8 | 8 | 200 | 48392 | 21164 | 15117 | 4025.8 | 3699.6 | 0.3 | 1.00 | 3699.58 |
| 1.0 | 8 | 200 | 47588 | 31333 | 22381 | 5960.3 | 5634.0 | 0.5 | 1.00 | 5634.02 |
| 1.2 | 8 | 200 | 46792 | 42161 | 30115 | 8019.9 | 7693.7 | 0.7 | 1.00 | 7693.65 |

What is claimed is:

1. An elongated pre-cast concrete element, said element having a substantially solid cross section including:

longitudinally extending upper and lower generally parallel surfaces that enable the element to be stacked with like elements when horizontally oriented;

longitudinally extending convex side surfaces joining the upper and lower surfaces end surfaces; and a reinforcing bar extending between said end surfaces.

2. The element of claim 1, further having a longitudinal passage extending between said end surfaces.

3. The element of claim 2, including said reinforcing bar located in said passage so as to extend between said end surfaces.

4. The element of claim 1, wherein the reinforcing bar is embedded within said element.

5. The element according to claim 4, wherein between adjacent upper and lower surfaces of adjoining elements is a layer of mortar or cement.

6. A wall structure including a plurality of elements, each element being an element according to claim 2, wherein the elements are stacked so each element is generally horizontally oriented.

7. A wall structure including a plurality of elements, each element being an element according to claim 3, wherein the elements are stacked so each element is generally horizontally oriented.

* * * * *

UNITED STATES PATENT AND TRADEMARK OFFICE

CERTIFICATE OF CORRECTION

PATENT NO. : 6,910,305 B1
DATED : June 28, 2005
INVENTOR(S) : Fahim Kassis

It is certified that error appears in the above-identified patent and that said Letters Patent is hereby corrected as shown below:

Title page,
Item [73], Assignee, delete "Fahim Cassis" and insert -- Fahim Kassis --.

Signed and Sealed this

Thirtieth Day of August, 2005

JON W. DUDAS
*Director of the United States Patent and Trademark Office*